United States Patent [19]

Yang

[11] Patent Number: 4,545,622

[45] Date of Patent: Oct. 8, 1985

[54] METHOD OF RUBBLIZATION FOR IN-SITU OIL SHALE PROCESSING

[76] Inventor: Lien C. Yang, 2107 Normanton Dr., La Canada-Flintridge, Calif. 91011

[21] Appl. No.: 541,517

[22] Filed: Oct. 13, 1983

[51] Int. Cl.[4] ..... E21B 41/10; E21B 43/247

[52] U.S. Cl. ..... 299/2; 102/312; 166/259; 299/13

[58] Field of Search ..... 299/2, 13; 166/259, 166/299; 102/312

[56] References Cited

U.S. PATENT DOCUMENTS 4,303,273 12/1981 Ricketts ..... 299/13 X
4,353,598 10/1982 Ricketts ..... 299/13 X
4,359,246 11/1982 Ricketts ..... 299/13 X
4,440,447 4/1984 Ricketts et al. ..... 299/13 X
4,444,433 4/1984 Ricketts ..... 299/13 X

*Primary Examiner*—George A. Suchfield
*Attorney, Agent, or Firm*—Norman L. Chalfin

[57] ABSTRACT

A method that produces a uniformly rubblized oil shale bed of desirable porosity for underground, in-situ heat extraction of oil. Rubblization is the generation of rubble of various sized fragments. The method uses explosive loadings lying at different levels in adjacent holes and detonation of the explosives at different levels in sequence to achieve the fracturing and the subsequent expansion of the fractured oil shale into excavated rooms both above and below the hole pattern.

5 Claims, 5 Drawing Figures

METHOD OF RUBBLIZATION FOR IN-SITU OIL SHALE PROCESSING

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

FIELD OF THE INVENTION

The invention generally relates to a method for fracturing an underground mineral by drilling vertical holes in the deposit and detonating explosives placed in the holes. More particularly, the present invention concerns a method to economically prepare a porous, rubblized oil shale bed for in-situ heat extraction of oil.

BACKGROUND ART

Major deposits of oil shale formations exist in the Western part of the United States. These formations contain a substance called kerogen which can be converted into a petroleum-like substance by application of heat. It is estimated that this reserved energy is larger than any other petroleum deposit. However, despite intensive efforts to devise economic techniques for shale oil extraction, this product is still not competitive with expensive crude oil.

One approach for extracting shale oil uses conventional mining techniques to remove large blocks of oil shale to the surface to be broken up into much smaller pieces for heat processing in above-ground retorts. This is a high-cost approach and produces undesirable effects, e.g., the disposal of expended oil shale.

Another approach which shows promise in reducing costs, with less environmental problems, processes the oil shale underground—in-situ oil shale processing. In this approach, two horizontal rooms, or tunnels, are bored one above and the other at the bottom of the portion of the deposit which is to be processed. Vertical, parallel holes, in which explosives are loaded, are drilled between the rooms. The explosives are detonated to effect "rubblization. The necessary heat for oil extraction from the oil shale rubble is provided by igniting the oil shale at the top of the rubble and burning the carbonaceous part of the oil shale in the presence of air which is pumped into the burning area. The shale oil extracted from the rock, in the presence of hot gas, drains down into the lower room from where it is pumped to the surface. A detailed description of in-situ oil shale processing is available in the references.

One key parameter which controls the successfulness of in-situ oil shale processing is the porosity in the oil shale rubble. The interstitial voids between the oil shale fragments facilitate flow passages for hot gas and extracted oil. Experiences have shown that a minimum porosity of 15 to 20% is necessary for efficient oil extraction. Porosity is defined as the volume percentage of voids in the rubble. Insufficient porosity will drastically reduce the amount of oil produced per oil shale mass processed. Relative rubble size uniformity is another important parameter which affects oil extraction efficiency.

In practice, both due to economic and safety reasons, only a limited number of holes can be drilled into the oil shale between the rooms; therefore, the volume ratio of the total hole volume to that of surrounding oil shale is far less than 15%. When the holes are filled with explosives and detonated, most oil shale is frozen in position even though it may be fractured. Only a small part of the oil shale near the top and bottom rooms is blown loose, and therefore, the major part of the oil shale has very poor porosity.

A departure from the conventional blasting technique is proposed in the invention. Unique explosive loadings and firing patterns are used to achieve sequential fracturing and loosening of the oil shale. An oil shale rubble of better porosity results.

STATEMENT OF THE INVENTION

The invention provides a method for efficiently rubblizing underground oil shale deposits to facilitate in-situ extraction of oil by a self-sustained retort process. The initial steps of the method adopt techniques used in the prior art. Two horizontal rooms are bored, one at the top and the other at the bottom of the portion of the deposit which is to be processed. Vertical holes, in which the explosives are to be loaded, are drilled between the rooms.

However, unlike the prior art in which the holes are fully-loaded with explosive and detonated, the invention uses only partially-loaded holes. The locations of the explosives in adjacent holes are at different levels. The explosives nearest the top and bottom rooms are detonated first. Next, a second blast(s) is generated by explosives located in the middle part of the deposit. The latter blast(s) is effective in expanding the fractured oil shale which is still frozen in place. Better porosity, or interstitial voids, is created between the rubble fragments. This is an effect that could not be achieved by the prior art.

In one exemplary embodiment of the invention three levels of explosives are used. This is achieved by using two types of explosive loadings in adjacent holes. In type A holes, explosives are loaded into the hole at the top and bottom ends for approximately one-third the hole length leaving an unloaded central section. In type B holes, explosive is loaded only in the central section covering one-third the hole length. Type A and B holes are detonated in sequence to produce a sequential blasting in the top, bottom and central sections of the oil shale. This arrangement is useful for the fabrication of a rubblized retort having a height to width (thickness to diameter) ratio of approximately 2.0 to 2.5.

In another exemplary embodiment of the invention, five levels of explosives are used. This is achieved by using three types of explosive loadings in the adjacent holes. In type A holes explosives are loaded at the top and bottom portions of the holes for approximately one-fifth of the hole length leaving an unloaded central section. In type C holes explosives are loaded at the two-fifth and four-fifth sections of the hole leaving unloaded sections in the top, bottom and central sections of the hole. In type B holes explosive is loaded only in the central section (three-fifth section) covering one-fifth of the hole length. The three types of holes are detonated in sequence to produce a sequential blasting in the end, intermediate and central sections of the oil shale in a symmetrical manner. This arrangement is useful for the fabrication of a rubblized retort having a height to width (thickness or diameter) ratio of approximately 2.5 to 3.5.

Further objectives, and many attendant advantages of the invention, may be best understood from the following detailed descriptions when read in conjunction with the accompanying drawings.

BEST MODE FOR CARRYING OUT THE INVENTION

Detailed illustrative embodiments of this invention, disclosed herein, exemplify this invention and are currently considered to be the best embodiments for such purposes. They are provided by way of illustration and not limitation of the invention. Various modifications thereof will occur to those skillful in the art, and such modifications are within the scope of the claims which define the present invention.

Figure 1:
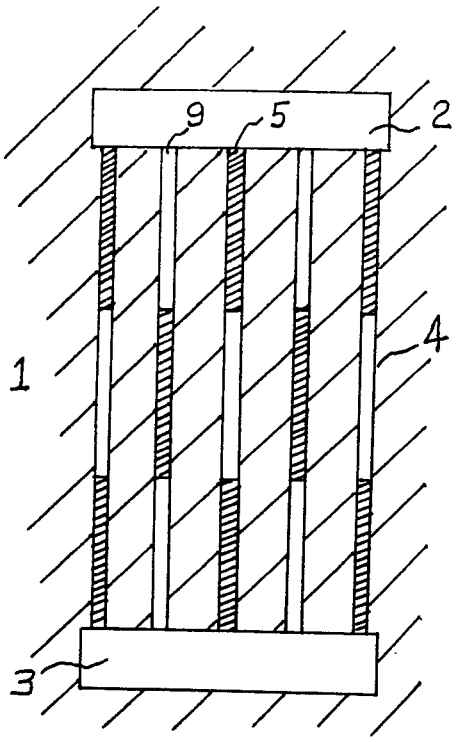
FIG. 1 is a schematic diagram showing the arrangement of one embodiment of the invention—the three-section blasting pattern.

Referring to FIG. 1, an underground oil shale deposit (1) is shown having a top room (2) and a bottom room (3) excavated so that the oil shale between them can be rubblized for in-situ heat extraction of oil. As shown in FIG. 1, the height to width (thickness or diameter) ratio of this portion of shale plus the rooms is approximately 2.0 to 2.5. The sum of the volumes of the rooms is approximately one-fourth that of the oil shale. Vertical holes (4) are drilled between the rooms. A state-of-the-art, pneumatic machine injects an extrudable high explosive such as ANFO (amoninium nitrade-fuel oil) into the holes. Two types of explosives loading of the holes are shown. In type A holes (5) explosives are loaded in the top (6) and bottom (7) sections for approximately one-third of the hole length leaving an unloaded central section (8). In type B holes (9) explosives are loaded only in the center section (10) covering one-third of the hole length leaving unloaded sections at the top (11) and bottom (12) sections of the hole.

Figure 2:
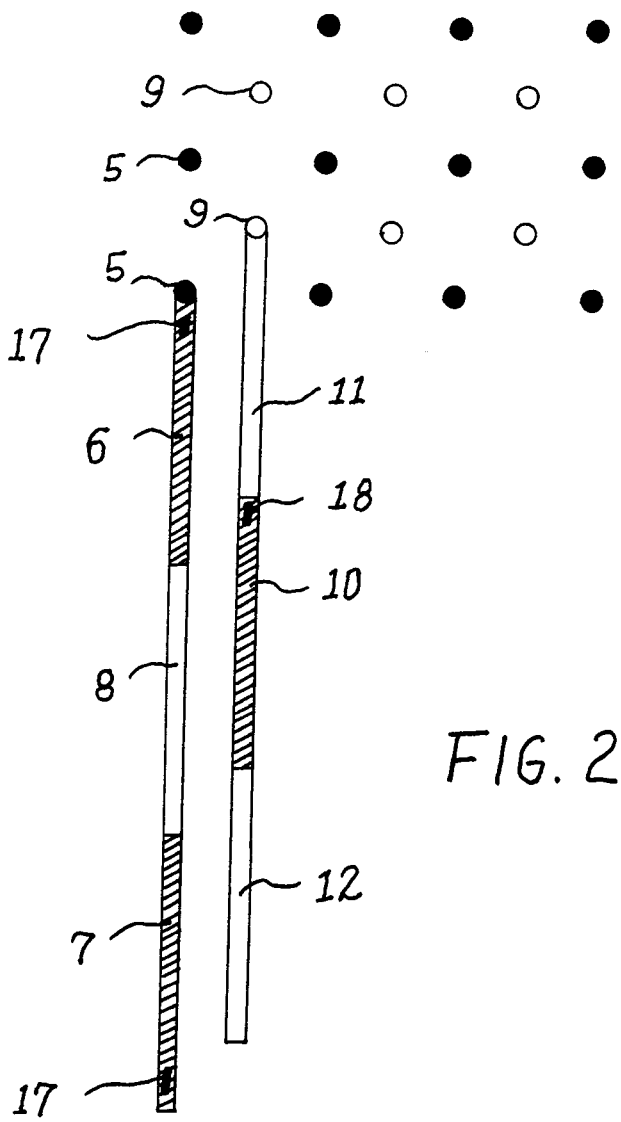
FIG. 2 is a perspective diagram showing the hole pattern and the explosive loading arrangement of the three-section blasting pattern.

The key feature of the spatial distribution pattern of these two types of holes is that each hole type is surrounded by the alternate hole type in a uniform, scalable manner. FIG. 2 shows a simple hole pattern in a square lattice configuration, i.e., each hole is surrounded by four holes of the alternate type located at the four corners of a square. Another exemplary pattern can be a hexagonal lattice configuration. In this arrangement, each type B hole is surrounded by six type A holes at the six corners of a hexagon, and each type A hole is surrounded by three type B holes.

The diameter of the holes can be from 4 to 12 inches depending upon the type of drilling machine applicable and the cost of the drilling operation. Usually, small diameter holes require a smaller drilling machine. Therefore, small diameter holes are cheaper and easier to implement. The separation between holes of the same type is usually 10 to 15 times the diameter of the hole to assure the proper fracture of the shale deposit—a fact well known in the art of rock blasting. The combination of hole diameter and hole spacing provides some design freedom. The objective is to achieve a relatively constant value in the total amount of explosive loaded into the holes per unit volume of oil shale to be rubblized. This design flexibility also makes the invention suitable for fabrication of oil shale retorts of different sizes, i.e., scalable. For the reason explained below, type B holes may be of larger diameter so that more explosives per length can be loaded into them as compared to the type A holes.

Figure 3:
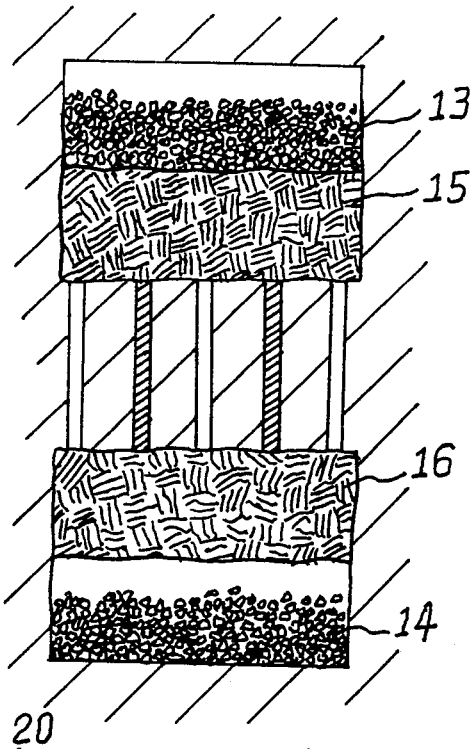
FIG. 3 is a schematic diagram showing the intermediate stage of operation of the three-section blasting pattern.

The explosives loaded into the type A holes are simultaneously detonated, while the explosives loaded into the type B holes are simultaneously detonated after an appreciable delay of approximately 10 milliseconds to several seconds from the first blast. In this arrangement, the unloaded sections of the holes function as burn holes for the blasting sequence. The first blast breaks loose part of the oil shale near the bottom and the top of the deposit into the top room (2) and bottom room (3) to form loose rubble (13) and (14) as shown in FIG. 3. Much of the shale in the top and bottom section (15) and (16) is internally fractured, but remains frozen in place so that no significant porosity is developed. The second blast in the central section of the type B holes pushes, loosens and expands the fractured oil shale into the space in rooms (2) and (3). Because blasting takes place at both ends of the central section of the oil shale, better rubblization is effected to produce more uniform porosity in the fractured oil shale in that section, i.e., fractured oil shale in the section, produced by the second blast, has less tendency to freeze in place. Higher explosive charge density is needed in the central section, because more energy is needed to effect expansion in the fractured, but frozen, end sections as well as fracturing and movement of the oil shale in the central section. The simplest way to achieve the required higher charge density is to use a larger hole diameter of the type B holes, therefore, more explosives can then be placed in the fixed one-third hole length in the central section.

The detonation of the explosives is initiated by state-of-the-art detonators, i.e., electrically initiated blasting caps. Two types of blasting caps are used. High-current-actuation, instant-initiated caps (17) are imbedded in the explosives in type A holes. This type cap can effect the detonation in tens of microseconds. Delayed function caps (18) are imbedded in the explosives in type B holes. Caps of this type can be delayed for a period of time ranging from tens of milliseconds to several seconds after the application of electrical current to the caps for detonation. In practice, all caps can be connected electrically in parallel, by lead-wires and can be initiated simultaneously. The delayed caps, after being initiated, will not need the further presence of electrical currents, i.e., they will detonate at a later time even though their lead wires could have been destroyed by the first blast.

The duration of the first blast is approximately several milliseconds. Therefore, the time delay for the second blast can be between ten milliseconds and several seconds. However, commercially-available, time-delayed caps have a time delay accuracy of about 10%. Thus, in order to effect a simultaneous detonation of all explosives in type B holes to form a delayed single blast milliseconds in duration, a shorter delay time of tens of milliseconds is more favorable.

Figure 4:
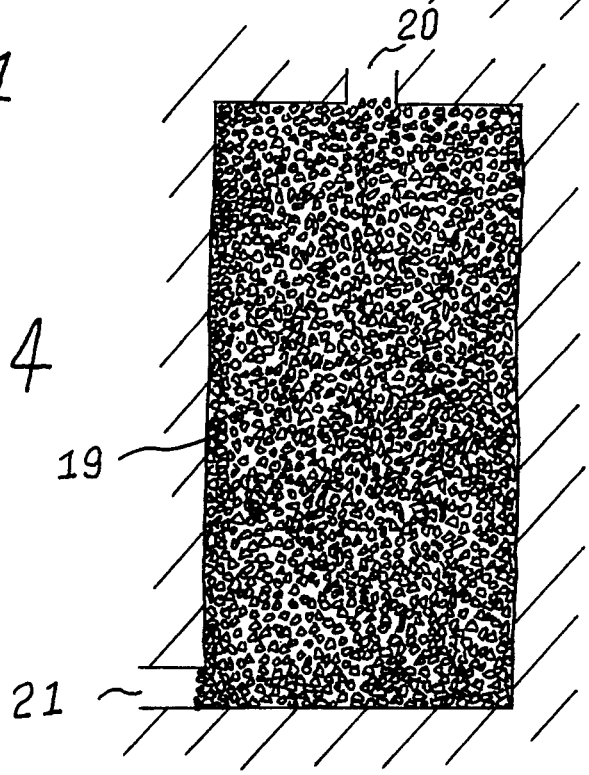
FIG. 4 is a schematic diagram showing the final result of the three-section blasting pattern.

FIG. 4 schematically shows the end results after the second blast. A uniform rubblized oil shale bed (19) is formed. The porosity of the bed is about 20 to 30%, because it is developed from the space provided by the excavated rooms (2) and (3). With the addition of the air input port (20) and the oil outlet port (21), the oil shale rubber is ignited from the top and the combustion progresses downward. The oil released by the heat drips to the bottom, and is pumped and transported to the surface.

Figure 5:
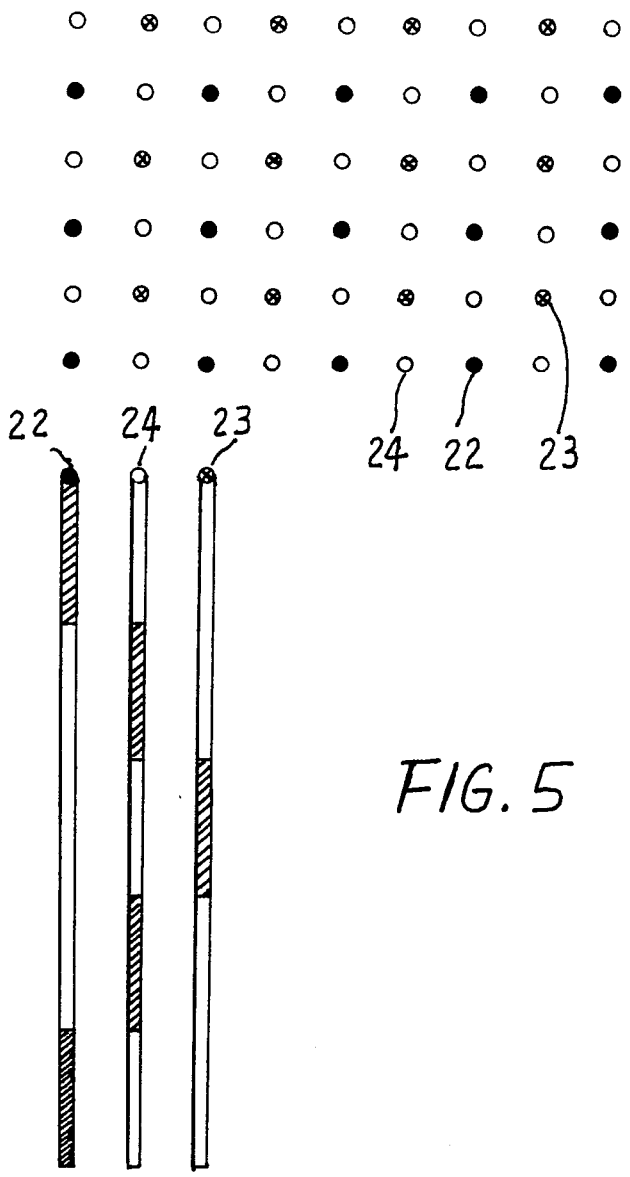
FIG. 5 is a perspective diagram showing the hole pattern and the explosive loading arrangement of the five-section blasting pattern.

Another exemplary embodiment of the invention is shown in FIG. 5. It can be used for the in-situ fabrication of a shale retort of a larger height to width (thickness or diameter) ratio on the order of 2.5 to 3.5. Because of the relatively larger height, the blast sequence uses more oil shale levels to effect a uniform rubble porosity. This is achieved by using three different types of hole loadings. Two loadings (22) and (23) correspond to the type A and B holes as described above, but the loadings extend only one-fifth of the hole length instead of one-third. The third type of loading (24) for type C holes, shown between the type A and B holes in FIG. 5, extends one-fifth of the hole length in a space arrangement which complements the type A and B holes. The firing sequence differs, because type C holes are fired after the firing of the type A holes, but before the firing of the type B holes. The same time-delay mentioned above is used in both type C and B hole firings. The principle of operation, design and results are similar to the three-section blast discussed earlier.

The apparent advantages of the invention, over methods in the prior art, are its intrinsic uniform design of the hole pattern, its simplicity and its ability to scale-up for fabrication of in-situ retorts of different sizes. It is relatively simple to excavate rooms at the top and the bottom of oil shale deposits to be processed. It is also simple to drill holes between rooms which have relatively small diameter and simple patterns as mentioned above. In the prior art, excavation of large voids involved complicated geometry and drilling of slant holes. The two- to three-step blast sequence is also advantageous. In the prior art, blasts of fully-loaded holes usually required many different delay times. Also, in the prior art it is not easy to apply the same hole pattern to fabricate retorts of different sizes. In the invention, due to the uniformity of the hole pattern, it can be scaled for fabrication of retorts of different sizes so long as the proper retort height to width (thickness or diameter) ratio is maintained as mentioned previously.

REFERENCES

U.S. Patent Documents

U.S. Pat. No. 3,001,776, 09/1961, Van Poollen
U.S. Pat. No. 3,687,075, 08/1972, Fritz
U.S. Pat. No. 3,902,422, 09/1975, Coursen
U.S. Pat. No. 4,015,664, 04/1977, Achenson et al.
U.S. Pat. No. 4,025,115, 05/1977, French et al.
U.S. Pat. No. 4,043,595, 08/1977, French
U.S. Pat. No. 4,109,964, 08/1978, Ridley

OTHER PUBLICATIONS

1. Langefors and Kihlström, "The Modern Technique of Rock Blasting," A Halsted Press Book, John Wiley & Sons, New York, 1978.

I claim:

1. A method of rubblization of underground oil shale deposits to produce a uniform porosity of at least 20% for in-situ heat extraction of oil comprising the steps of:

a. excavating two rooms, one above and one below an oil shale deposit to be processed, said excavation producing rooms of a predetermined cross-sectional configuration, each of said rooms occupying at least 10% of said oil shale deposit;

b. drilling vertical holes of predetermined diameter between said rooms in a uniform, periodically repeated parallel pattern throughout said oil shale deposit;

c. charging each of said holes with a detonatable explosive, said explosive being disposed in each hole is centered symmetrically therein, and said explosive disposed in adjacent ones of said holes are positioned at different levels therein;

d. detonating explosives in holes at each of said different levels simultaneously, with time delays between the detonations of explosives at one level with respect to a successive detonation at a different level, in a sequence where said explosives in the two levels nearest to said two excavated rooms are detonated first followed by the detonation of said explosives in said levels adjacent to said levels nearest to said two excavated rooms, said detonations proceeding progressively toward the inner levels of the oil shale deposit sequentially and symmetrically to the horizontal central plane of the oil shale deposit;

e. detonating said explosives with single electric pulse initiated blasting caps connected electrically in parallel, by lead wires which can initiate all the caps some instantaneously and some after a time delay depending upon their location in the rooms, and exceeding the duration of the successive blasts;

f. the resulting in situ rubblization of the oil shale for retorting being created to a height of at least one hundred feet with a height to width ratio of 2.0 to 3.5.

2. The method defined in claim 1, including the following additional steps:

a. dividing the explosive loadings into three levels;

b. disposing the hole location pattern and explosives loading therein to follow a two-dimensional, square lattice configuration and distribution;

c. using two types of hole loadings, each type of hole being surrounded by four holes of an alternate type located at the four corners of said square lattice configuration;

d. loading explosives in each of the top and bottom sections of holes of one type to approximately one-third of the hole length, leaving an unloaded central section;

e. loading explosives in the central section of holes of the other type, to approximately one-third of the hole length, leaving unloaded sections at the top and bottom ends of each of said other type holes;

f. detonating the explosives in said one type of holes simultaneously, followed by a delayed second detonation of explosives in said other type holes simultaneously;

g. providing a distance between adjacent holes of the same type of at least 10 times the diameter of the hole; and h. providing the diameter of said other type holes to be larger than said one type holes so that more explosives per length can be loaded into said other type of holes.

3. The method defined in claim 1, including the following steps:

a. dividing the loadings into five levels;

b. disposing hole locations to following a two-dimensional, square lattice configuration and distribution;

c. providing three types of hole loadings, wherein each of two types of holes is surrounded by four of a third type of hole located at the corners of a square lattice configuration, wherein each of said third type hole is surrounded by two of each of said two types of holes symmetrically;

d. loading explosives in the top and bottom sections of one of said two types of holes to approximately one-fifth of the hole length, leaving an unloaded central section;

e. loading explosives in the central section of the others of said two types of holes to approximately one-fifth of the hole length, leaving unloaded portions at the top and bottom sections of the hole;

f. loading explosives in the two-fifth and four-fifth sections of said holes of said third type to approximately one-fifth of the hole length, leaving unloaded sections at the top, bottom and central sections of the hole;

g. detonating explosives in said first of said two types of holes first, followed by a delayed second detonation of explosives in said third type of holes, followed by a delayed third detonation of explosives in the second of said two types of holes, each of the delayed detonations of explosives occurring simultaneously for the respective types of holes involved;

h. providing a distance between adjacent holes of the same type of at least 10 times the diameter of the hole; and i. providing hole diameters for each of the three types of holes so that some may be larger than others to permit greater quantities of explosives to be loaded in the larger holes than in the smaller holes.

4. A method for rubblization of oil shale deposits comprising the steps of:

a. excavating rooms above and below the oil shale deposit to be rubblized;

b. drilling a series of holes vertically through the oil shale deposit, the room, above said deposit and the room below said deposit, said holes being parallel to one another and arrayed in a predetermined pattern;

c. loading portions of said holes with explosives disposed therein so that said explosives in adjacent holes in the array are at different levels; and d. detonating said explosives in a time delayed sequence such that explosives at any one level are exploded simultaneously followed by detonation of the explosives at another level, the sequence being designed to detonate the charges nearest the excavated rooms first, followed by the detonation of charges located in the central portions of the shape deposit, the sequence of explosions progressing from the upper and lower portions towards the central portion of the shale deposit between said excavated rooms, thereby to more completely rubblize the oil shale so that the oil in the shale may more easily be extracted by retorting.

5. In the method defined in claim 4, the array pattern of the holes for receiving explosive charges being such that a central hole has a centrally located portion with an explosive charge therein and the surrounding holes, forming a predetermined pattern about the central hole having charges in their respective upper and lower portions, the pattern of central holes and surrounding holes being repeated over the area selected for rubblization.

* * * * *